US009944067B1

(12) United States Patent
Ohnishi et al.

(10) Patent No.: US 9,944,067 B1
(45) Date of Patent: Apr. 17, 2018

(54) PRINTING APPARATUS

(71) Applicant: MIMAKI ENGINEERING CO., LTD., Nagano (JP)

(72) Inventors: Masaru Ohnishi, Nagano (JP); Akifumi Seki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/806,333

(22) Filed: Nov. 8, 2017

Related U.S. Application Data

(62) Division of application No. 15/316,179, filed as application No. PCT/JP2015/066327 on Jun. 5, 2015.

(30) Foreign Application Priority Data

Jun. 6, 2014 (JP) ..... 2014-117594

(51) Int. Cl.
*B41J 29/38* (2006.01)
*B41J 2/045* (2006.01)
*B41J 25/308* (2006.01)

(52) U.S. Cl.
CPC ..... *B41J 2/04503* (2013.01); *B41J 2/04586* (2013.01); *B41J 25/308* (2013.01)

(58) Field of Classification Search
USPC ..... 347/5, 9, 17, 54, 100
See application file for complete search history.

(56) References Cited

U.S. PATENT DOCUMENTS 6,164,773 A * 12/2000 Oikawa ..... B41J 2/04503 347/100
7,059,698 B1 * 6/2006 Marra, III ..... B41J 2/5056 347/37
2009/0231370 A1 * 9/2009 Ohnishi ..... B41J 3/4073 347/9
2009/0256880 A1 * 10/2009 Ohnishi ..... B41J 11/0015 347/17

* cited by examiner

*Primary Examiner* — Lam Nguyen
(74) *Attorney, Agent, or Firm* — JCIPRNET

(57) ABSTRACT

To more appropriately carry out printing at high precision even when a gap distance is large. A printing apparatus includes an inkjet head, a main scan driver, and a controller, where the controller sets a moving speed of the inkjet head according to a gap distance, and sets the moving speed in a main scanning operation so that an entering angle at a time of landing of the ink droplet on a medium becomes smaller than or equal to 45 degrees with respect to at least a position where the gap distance becomes the largest in a region of the medium to become a target of the main scanning operation.

1 Claim, 10 Drawing Sheets

PRINTING APPARATUS

CROSS-REFERENCE TO RELATED APPLICATION

This application is a divisional application of and claims the priority benefit of U.S. patent application Ser. No. 15/316,179, filed on Dec. 5, 2016, now pending, which is a 371 application of the international PCT application serial no. PCT/JP2015/066327, filed on Jun. 5, 2015, which claims the priority benefits of Japan application no. JP 2014-117594, filed on Jun. 6, 2014. The entirety of each of the above-mentioned patent applications is hereby incorporated by reference herein and made a part of this specification.

TECHNICAL FIELD

The present invention relates to a printing apparatus and a printing method.

BACKGROUND ART

An inkjet printer capable of carrying out printing on objects of various shapes such as a three-dimensional object has been recently developed (see e.g., Patent Literature 1). A serial type inkjet printer that causes an inkjet head to carry out a main scanning operation (scan operation) is being widely used for such inkjet printer.

CITATION LIST

Patent Literature

Patent Literature 1: Japanese Unexamined Patent Publication No. 2005-280110

SUMMARY

Technical Problems

When using objects of various shapes such as a three-dimensional object as a medium, which is a target of printing (print object), a gap distance (gap length), which is a distance between the medium and the inkjet head, sometimes becomes large. If printing is carried out through the inkjet method, however, shift and variation in a landing position of an ink droplet tends to become large when the gap distance becomes large. As a result, printing sometimes becomes difficult to carry out at high precision. Thus, a configuration in which printing can be more appropriately carried out at high precision even when the gap distance is large is conventionally desired. It is thus an aim of the present invention to provide a printing apparatus and a printing method capable of solving such problem.

Solutions to the Problems

The inventors of the present application thoroughly researched the relationship of the gap distance and the shift, and the like in the landing position of when carrying out printing through the inkjet method. First, the inventors focused on the fact that the shift and the variation in the landing position are significant when the gap distance becomes larger than a distance of a certain degree. Through further thorough research, the inventors found out that a relationship with an entering angle at the time of landing when the ink droplet discharged from a nozzle of the inkjet head lands on the medium is large with respect to a magnitude of the shift, and the like in the landing position.

More specifically, the inventors focused on the fact that when carrying out printing through the inkjet method according to the conventional configuration, the entering angle of the ink droplet at the time of landing also becomes large when the gap distance becomes large. In such a case, the entering angle of the ink droplet is an angle formed by a flying direction of the ink droplet at the time of landing and a discharging direction in which the ink droplet is discharged from the nozzle. More specifically, for example, when the ink droplet is discharged from the nozzle toward a lower side in a vertical direction, the entering angle of the ink droplet is an angle formed by the flying direction of the ink droplet at the time of landing and the vertically downward direction. The inventors of the present application further found out that when the gap distance is large, the shift, and the like in the landing position become large as the entering angle at the time of landing becomes large.

When printing is carried out by causing the inkjet head to carry out the main scanning operation, the inkjet head discharges the ink droplet while moving in a main scanning direction set in advance during the main scanning operation. Thus, the flying direction of the ink droplet discharged from the nozzle has a component in a moving direction of the inkjet head at the time of discharge according to the law of inertia.

In the inkjet head, however, a discharging speed (initial speed) at which the ink droplet is discharged from the nozzle is usually sufficiently large compared to the moving speed of the inkjet head. More specifically, the discharging speed of the ink droplet is usually about five to fifteen times the moving speed of the inkjet head. Thus, the flying direction of the ink droplet becomes a direction close to the discharging direction immediately after the discharge of the ink droplet.

Furthermore, when the gap distance is small (e.g., about 2 mm or smaller), the change in the flying direction of the ink droplet from immediately after the discharge is assumed to be small. Thus, in such a case, the entering angle of the ink droplet at the time of landing is assumed to be a small angle of the same extent as immediately after the discharge. In such a case, the flying direction of the ink droplet immediately after the discharge is a direction determined by a composition of the discharging speed of the ink droplet and the moving speed of the inkjet head. Furthermore, the entering angle of the ink droplet becomes small, and hence the shift, and the like in the landing position are less likely to occur.

When the gap distance is large, on the other hand, the change in the flying speed of the ink droplet caused by air resistance becomes large, whereby the entering angle of the ink droplet may not be the same extent as immediately after the discharge. More specifically, the influence of air resistance usually becomes larger the faster the speed. Thus, after being discharged from the nozzle, the speed component in the discharging direction of a faster speed is greatly subjected to the influence of air resistance. As a result, the entering angle of the ink droplet at the time of landing gradually becomes large when the gap distance becomes large. When the entering angle becomes large, the shift, and the like in the landing position tend to easily occur. Furthermore, when the gap distance is large, atomization, and the like of the ink droplet sometimes occur if the speed in the discharging direction becomes too small.

As described above, the flying direction of the ink droplet is also subjected to the influence of the moving speed of the inkjet head at the time of discharge. As apparent from the description and the like made above, the entering angle at the time of landing becomes smaller the slower the moving speed of the inkjet head.

The inventors of the present application came up with an idea of changing the moving speed of the inkjet head at the time of the main scanning direction according to the gap distance, and slowing the moving speed when the gap distance is large. Furthermore, more specifically, the inventors came up with an idea of, for example, adjusting the moving speed of the inkjet head such that the entering angle at the time of landing becomes smaller than or equal to 45 degrees. According to such configuration, the component toward the medium can be made greater than the component in the moving direction of the inkjet head with respect to the flying direction of the ink droplet immediately before the landing. Moreover, the shift, and the like in the landing position can be assumed to be appropriately prevented from becoming large. Since the ink droplet can be landed while maintaining the component toward the medium to a certain degree, it can also be assumed that the atomization, and the like of the ink droplet can be appropriately prevented. In other words, the present invention has the following configuration in order to solve the problem described above.

(First Configuration)

A printing apparatus that carries out printing through an inkjet method with respect to a medium, the printing apparatus including an inkjet head with a nozzle that discharges an ink droplet on the medium; a main scan driver that causes the inkjet head to carry out a main scanning operation of discharging the ink droplet while moving in a main scanning direction set in advance; and a controller that controls a moving speed of moving the inkjet head in the main scanning operation; wherein the controller sets the moving speed according to a gap distance, which is a distance between a nozzle surface and the medium, and the nozzle surface is a surface where the nozzle is forming in the inkjet head; and sets the moving speed in the main scanning operation so that an entering angle at a time of landing of the ink droplet on the medium becomes smaller than or equal to 45 degrees with respect to at least a position where the gap distance becomes the largest in a region of the medium to become a target of the main scanning operation.

In such configuration, the medium is, for example, a target object of printing. The medium is, for example, a three-dimensional object, and the like. The position where the gap distance becomes the largest may be a position where the gap distance becomes the largest of the landing positions determined according to the resolution of printing.

When configured in such manner, the entering angle of the ink droplet can be appropriately prevented from becoming too large even at the landing position where the gap distance becomes large. Moreover, the shift, and the like in the landing position can be appropriately suppressed. Furthermore, in such a case, the ink droplet can be landed while maintaining the component toward the medium to a certain degree, so that atomization and the like of the ink droplet can also be appropriately prevented. Furthermore, according to such configuration, printing can be more appropriately carried out at high precision even when the gap distance is large.

(Second Configuration)

The controller changes the moving speed at a timing of discharging the ink droplet to each position according to a gap distance at each position in the region of the medium to become the target of the main scanning operation while the inkjet head carries out one main scanning operation.

According to such configuration, the moving speed of the inkjet head can be appropriately set in accordance with the gap distance at each position. Printing thus can be appropriately carried out at high precision even when the gap distance is large at any of the positions.

(Third Configuration)

The controller sets the moving speed to a maximum speed set in advance with respect to a position where the gap distance is smaller than or equal to a set gap, which is a distance set in advance; and sets the moving speed to a speed lower than the maximum speed with respect to a position where the gap distance becomes greater than the set gap.

When the gap distance is small, it is assumed that the shift, and the like in the landing position are less likely to occur even when the moving speed of the inkjet head is made extremely high. However, control may become difficult if the moving speed of the inkjet head is made too high. Furthermore, the cost of the apparatus may greatly increase as the required performance on the apparatus increases.

When configured in such manner, such problems can be appropriately prevented from arising by setting a predetermined maximum speed for the moving speed of the inkjet head. When the gap distance is large, the shift, and the like in the landing position can be appropriately suppressed by slowing the moving speed of the inkjet head. Thus, printing can be more appropriately carried out at high precision even when the gap distance is large according to the configuration described above.

(Fourth Configuration)

When Vi, which is a component in a discharging direction of the ink droplet, in a flying speed of the ink droplet is approximated as $Vi=V\mathbf{0}\times\exp(-t/\tau)$ using a time constant $\tau$, V0 being a discharging speed at which the inkjet head discharges the ink droplet from the nozzle, and t being a time elapsed after the ink droplet is discharged from the nozzle, the controller sets a moving speed Vh of the inkjet head at a timing of discharging the ink droplet to each position in the region of the medium to become a target of the main scanning operation so that $Vh\leq Vi$ is obtained until at least each ink droplet discharged to each position lands on the medium. According to such configuration, for example, a speed corresponding to the gap distance can be appropriately set for the moving speed of the inkjet head.

(Fifth Configuration)

When $N=V\mathbf{0}/Vh_{max}$, $Vh_{max}$ being a maximum speed set in advance for the moving speed and V0 being a discharging speed at which the inkjet head discharges the ink droplet from the nozzle, the controller sets the moving speed Vh so that $Vi/Vh\geq N$ is obtained for a relationship of the moving speed Vh of the inkjet head and Vi, which is a component in the discharging direction of the ink droplet, in the flying speed of the ink droplet at a landing position, with respect to each position in the region of the medium to become the target of the main scanning operation. In this case, the speed Vi may, for example, be a speed at the timing of landing. According to such configuration, for example, a speed corresponding to the gap distance can be appropriately set for the moving speed of the inkjet head.

(Sixth Configuration)

The controller sets the moving speed of the inkjet head for every main scanning operation; the controller sets the moving speed in the main scanning operation to a maximum speed set in advance when a maximum value of the gap distance in the region of the medium to become the target of the main scanning operation is smaller than or equal to a set gap, which is a distance set in advance; and the controller sets the moving speed in the main scanning operation according to the maximum value of the gap distance in the region when the gap distance is greater than the set gap at any position in the region of the medium to become the target of the main scanning operation. The controller moves the inkjet head, for example, at a constant moving speed in each main scanning operation.

When configured in such manner, for example, the shift, and the like in the landing position of the ink droplet can be appropriately suppressed even when the gap distance is large by setting the moving speed of the inkjet head in accordance with the position where the gap distance becomes the largest. Furthermore, for example, control can be appropriately prevented from becoming complex by setting a maximum speed or making the moving speed in each main scanning operation constant for the speed of the inkjet head. According to such configuration, a speed corresponding to the gap distance can be more simply and appropriately set for the moving speed of the inkjet head.

The controller sets the moving speed of the inkjet head, for example, for every main scanning operation. The controller may set the moving speed of the inkjet head for every plurality of main scanning operations set in advance.

(Seventh Configuration)

When the gap distance is greater than an upper limit distance set in advance at any position in the medium, the controller brings the inkjet head to rest at least at a timing of discharging the ink droplet to a position where the gap distance becomes greater than the upper limit distance. The upper limit distance may, for example, be a distance of about 10 mm.

According to such configuration, the shift, and the like in the landing position can be appropriately suppressed even when the gap distance is particularly large. Furthermore, printing thus can be more appropriately carried out at high precision.

In such configuration, the main scan driver preferably includes, for example, a stepping motor as a power source for the movement of the inkjet head. In this case, the inkjet head can be appropriately brought to rest by appropriately stopping the stepping motor.

(Eighth Configuration)

A printing method of carrying out printing through an inkjet method with respect to a medium, the printing method including the steps of causing an inkjet head, including a nozzle that discharges an ink droplet on the medium, to carry out a main scanning operation of discharging the ink droplet while moving in a main scanning direction set in advance; and controlling a moving speed of moving the inkjet head in the main scanning operation; wherein controlling the moving speed includes setting the moving speed according to a gap distance, which is a distance between a nozzle surface and the medium, and the nozzle surface is a surface where the nozzle is formed in the inkjet head; and setting the moving speed in the main scanning operation so that an entering angle at a time of landing of the ink droplet on the medium becomes smaller than or equal to 45 degrees with respect to at least a position where the gap distance becomes the largest in a region of the medium to become a target of the main scanning operation. According to such configuration, for example, effects similar to configuration 1 can be obtained.

Effect of the Invention

According to the present invention, printing can be more appropriately carried out at high precision even when the gap distance is large.

BRIEF DESCRIPTION OF THE DRAWINGS

FIG. 1A shows one example of a configuration of a main section of the printing apparatus 10. FIG. 1B shows an operation of carrying out printing on a convex medium 50 serving as a printing target in a simplified manner.

FIG. 2A shows one example of a manner of flying of the ink droplet 302. FIG. 2B is a view showing one example of an entering angle at a time of landing on the medium 50.

FIG. 5A is a graph showing one example of setting of the moving speed Vy. FIG. 5B is a view describing a flying direction of the ink droplet.

FIG. 10A shows a first problem that arises in the three-dimensional object molding apparatus.

FIGS. 10B and 10C show a second problem that arises in the three-dimensional object molding apparatus.

DESCRIPTION OF EMBODIMENTS

Figure 1A:
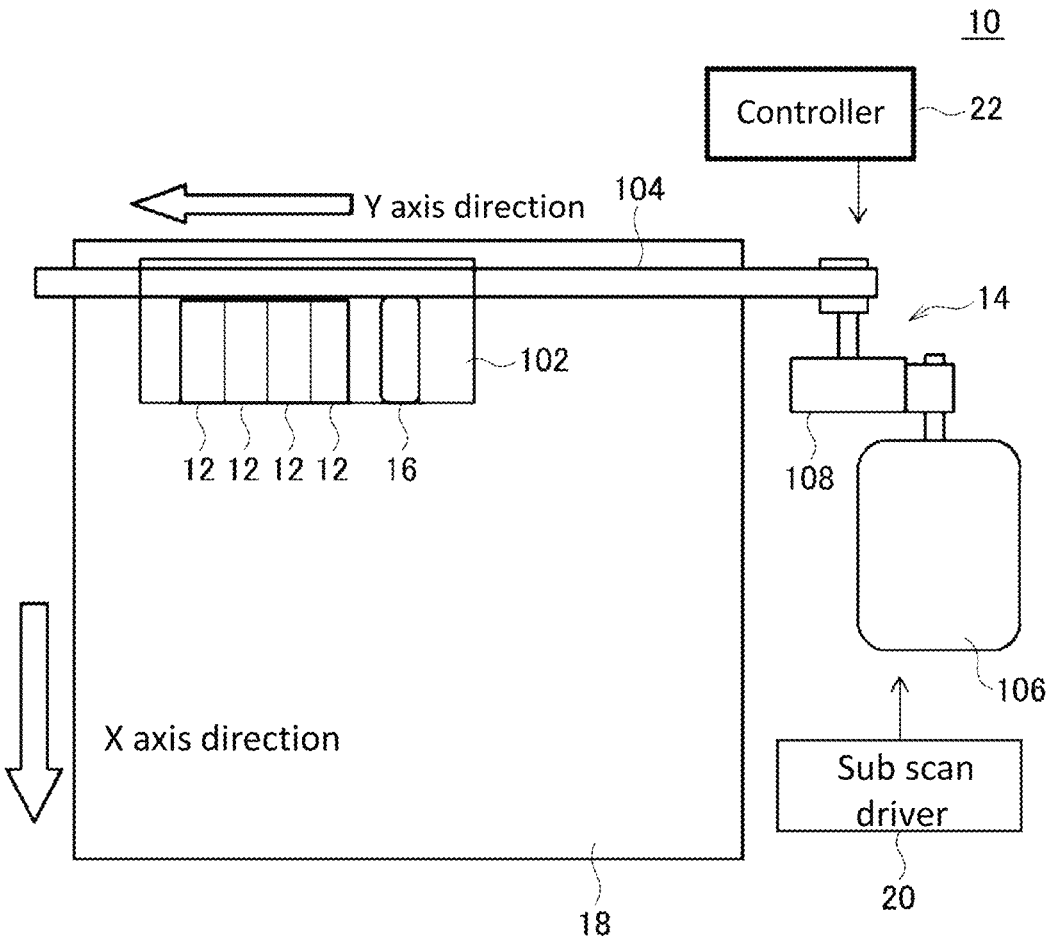
FIG. 1A and FIG. 1B are views showing one example of a printing apparatus 10 according to one embodiment of the present invention.
Figure 1B:
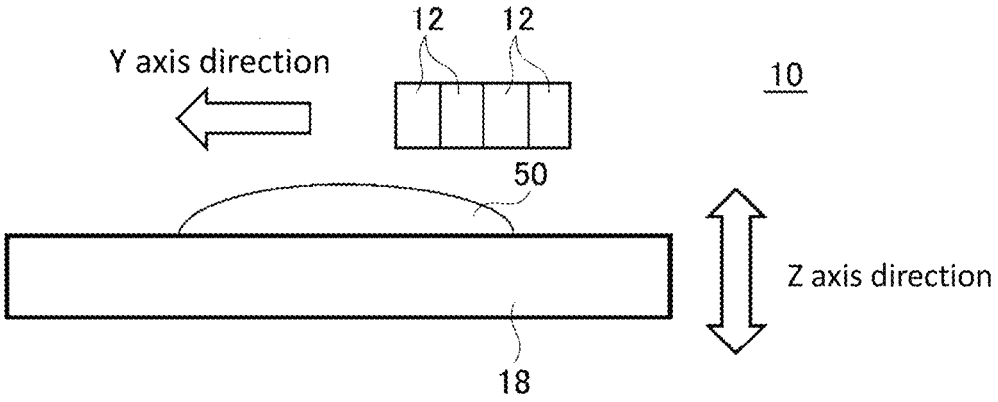

Hereinafter, an embodiment according to the present invention will be described with reference to the drawings. FIG. 1A and FIG. 1B show one example of a printing apparatus 10 according to one embodiment of the present invention. FIG. 1A shows one example of a configuration of a main section of the printing apparatus 10. FIG. 1B shows an operation of carrying out printing on a convex medium 50 serving as a printing target in a simplified manner. Other than aspects described below, the printing apparatus 10 may have a configuration same as or similar to the known inkjet printer.

The printing apparatus 10 is an inkjet printer that carries out printing through the inkjet method with respect to the medium 50. In the present example, the printing apparatus 10 is, for example, an inkjet printer that causes an inkjet head to carry out a main scanning operation to perform printing through a serial method, and includes a plurality of inkjet heads 12, a main scan driver 14, an ultraviolet light source 16, a table 18, a sub scan driver 20, and a controller 22.

The plurality of inkjet heads 12 are print heads including a nozzle for discharging the ink droplet onto the medium 50, and discharge the ink droplet to each position of the medium 50 by carrying out the main scanning operation according to an instruction of the controller 22. In this case, the main scanning operation is an operation of discharging the ink droplet on the medium 50 while moving in the main scanning direction (Y axis direction in the figure) set in advance. Furthermore, in the present example, the plurality of inkjet heads 12 discharge the ink droplet of an ultraviolet curing ink. Each of the plurality of inkjet heads 12 discharges the ink droplet of a different color ink. More specifically, each of the plurality of inkjet heads 12 discharges the ink droplet of each color of the CMYK ink.

The printing apparatus 10 may further include an inkjet head 12 other than each color of CMYK. For example, the printing apparatus 10 may further include an inkjet head 12 for white or for clear color. In the present example, the plurality of inkjet heads 12 are arranged side by side in the main scanning direction with the respective positions in the sub scanning direction aligned. In such a case, the sub scanning direction is a direction (X axis direction in the figure) orthogonal to the main scanning direction. Although the illustration is omitted, in the present example, each inkjet heads 12 includes a nozzle row in which a plurality of nozzles are lined in the sub scanning direction.

The main scan driver 14 is a driving unit that causes the plurality of inkjet heads 12 to carry out the main scanning operation. In the present example, the main scan driver 14 includes a carriage 102, a stepping motor 106, a gear 108, and a conveyance belt 104. The carriage 102 holds the plurality of inkjet heads 12 with a nozzle surface of each inkjet head 12 facing the medium 50. In such a case, the nozzle surface of the inkjet head 12 is a surface where the nozzle is formed in the inkjet head 12.

The stepping motor 106 is a motor serving as a power source for moving the plurality of inkjet heads 12 at the time of the main scanning operation. In the present example, the stepping motor 106 moves the plurality of inkjet heads 12 at a preset speed at the time of the main scanning operation by rotating at a speed corresponding to an instruction of the controller 22. The gear 108 is a gear that transmits the power of the stepping motor 106 to the conveyance belt 104.

The conveyance belt 104 is a belt member that moves the carriage 102, and is stretched across so as to move the carriage 102 in the main scanning direction. The conveyance belt 104 moves the carriage 102 by moving according to the power of the stepping motor 106 received through the gear 108. Thus, at the time of the main scanning operation, the conveyance belt 104 moves the plurality of inkjet heads 12 in the main scanning direction. The main scan driver 14 may further include, for example, a guide rail for guiding the movement of the carriage 102, and the like.

The ultraviolet light source 16 is an ultraviolet irradiating device, and cures an ultraviolet curing ink landed on the medium 50 by irradiating the ink with ultraviolet ray. UVLED, and the like, for example, can be suitably used for the ultraviolet light source 16.

In the case illustrated in FIG. 1A, the printing apparatus 10 is a one-direction print printer that carries out only the main scanning direction in one direction. In such a case, carrying out only the main scanning operation in one direction means having the direction of the main scanning operation of the inkjet head 12 to only one side in the main scanning direction. In this case, the ultraviolet light source 16 is disposed only on one side in the main scanning direction with respect to the plurality of inkjet heads 12, as shown in FIG. 1A. This one side is a side to become the back side of the inkjet head 12 at the time of the main scanning operation.

The printing apparatus 10 may, for example, be configured for bi-directional print for carrying out the main scanning operation in both directions. In such a case, for example, the ultraviolet light source 16 is preferably disposed on both sides of the main scanning direction with respect to the inkjet head 12. The ultraviolet light source 16 may be disposed on both sides in the main scanning direction with respect to the inkjet head 12 even when, for example, carrying out only the main scanning operation in one direction.

The table 18 is a platform-like member for placing the medium 50, and supports the medium 50 with the medium 50 facing the nozzle surface of each of the plurality of inkjet heads 12. The table 18 of the present example has a function of moving an upper surface for placing the medium 50 in a predetermined up and down direction (Z axis direction in the figure). In this case, the up and down direction is a direction orthogonal to the main scanning direction and a sub scanning direction.

The table 18 of the present example can allow the distance between the nozzle surface of the inkjet head 12 and the table 18 to be appropriately adjusted by moving the upper surface in the up and down direction. Thus, in the present example, for example, printing can be carried out even with respect to a thick three-dimensional medium 50, as shown in FIG. 1B. The operation of carrying out printing on the three-dimensional medium 50 will be described in detail later.

The sub scan driver 20 is a driving unit that causes the plurality of inkjet heads 12 to carry out the sub scanning operation. In this case, the sub scanning operation is an operation of relatively moving the inkjet head with respect to the medium 50 in the sub scanning direction. Furthermore, in the present example, the sub scan driver 20 is a driving unit for moving the main scan driver 14 while holding the plurality of inkjet heads 12, and moves the main scan driver 14 between the interval of the main scanning operations to cause the plurality of inkjet heads 12 to carry out the sub scanning operation.

Consideration is made to using a configuration of fixing the position of the inkjet head 12 in the sub scanning direction, and moving the medium 50 to carry out the sub scanning operation, for example, for the configuration of the printing apparatus 10. In this case, a driving unit for moving the table 18, and the like, for example, can be used for the sub scan driver 20.

The controller 22 is, for example, a CPU of the printing apparatus 10, and controls the operation of each unit of the printing apparatus 10 according to an instruction of a host PC. According to the above configuration, the printing apparatus 10 carries out printing with respect to the medium 50. In the present example, the controller 22 controls the moving speed of moving the inkjet head 12 in the main scanning operation. Control of the moving speed will be further described in detail later.

Figure 2A:
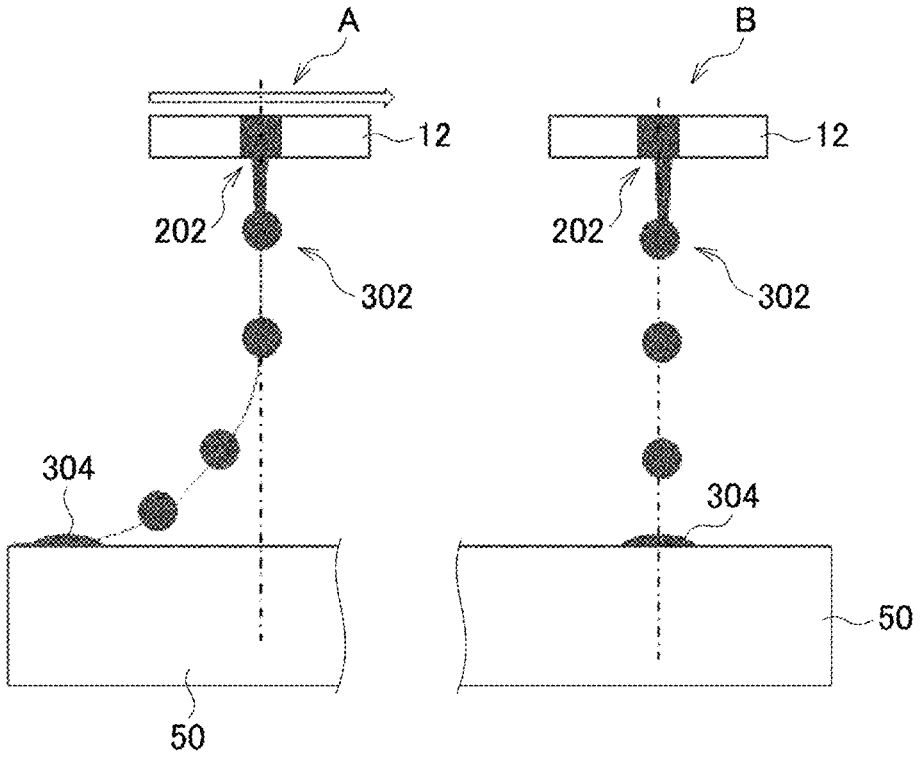
FIG. 2A and FIG. 2B are views describing a state in which an ink droplet 302 discharged from a nozzle 202 of an inkjet head 12 flies.
Figure 2B:
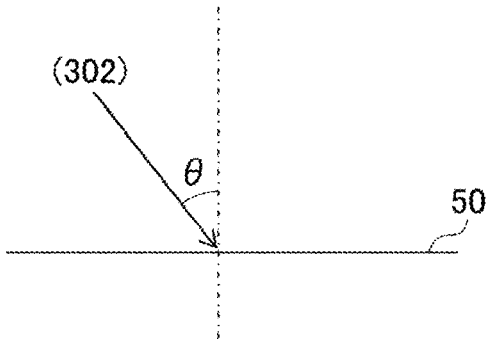

Next, the main scanning operation carried out in the present example will be further described in detail. FIG. 2A and FIG. 2B are views describing a state in which an ink droplet 302 discharged from a nozzle 202 of an inkjet head 12 flies. FIG. 2A is a view showing one example of a manner of flying of the ink droplet 302, and shows a state observed from the position speed synchronized with the inkjet head.

In the main scanning operation, when the inkjet head 12 discharges the ink droplet 302 while moving, the speed of the ink droplet 302 after being discharged contains a component in the moving direction of the inkjet head 12 at the time of discharge according to the law of inertia. The ink droplet 302 after being discharged thus advances toward the medium 50 while moving in the same direction as the inkjet head 12.

However, when carrying out printing in the atmosphere, which is a usual environment, the flying ink droplet 302 is subjected to the influence of air resistance. As a result, the flying speed of the ink droplet 302 gradually changes after being discharged. The influence of air resistance received by the ink droplet 302 until landing on the medium 50 becomes larger the larger the gap distance. In this case, the gap distance is a distance between the nozzle surface of the inkjet head 12 and the medium 50.

More specifically, in FIG. 2A, a figure on the left side denoted with a reference numeral A shows one example of a state of flying of the ink droplet 302 when the gap distance is large (wide gap) and when a moving speed Vy of the inkjet head 12 at the time of the main scanning operation is high speed. The state of flying of the ink droplet 302 in the figure is a state of flying of the ink droplet 302 when the inkjet head 12 is seen from the sub scanning direction.

Assuming a component (speed) in the discharging direction in the flying speed of the ink droplet 302 is Vi, the Vi immediately after the discharge is usually about five to fifteen times the moving speed Vy of the inkjet head 12. Furthermore, the influence of air resistance is usually larger the faster the speed. Thus, the influence of air resistance received by the flying ink droplet 302 is assumed to be particularly large at the speed Vi in the discharging direction.

In this case, the speed Vi in the discharging direction becomes slow at a landing time point, and the landing position is greatly subjected to the influence of the moving speed Vy of the inkjet head 12. More specifically, for example, when the gap distance is large as in the figure denoted with the reference numeral A, the flight bend occurs, and the position where a dot 304 of the ink is formed by the landing of the ink droplet 302 greatly shifts compared to when not subjected to the influence of air resistance. Furthermore, in this case, the shift in the landing position becomes large even if the timing of landing is shifted only slightly as the speed Vi in the discharging direction becomes slow. As a result, the variation in the landing position also becomes large.

On the other hand, in FIG. 2A, a figure on the right side denoted with a reference numeral B shows one example of a state of flying of the ink droplet 302 when the ink droplet 302 is discharged from the stopped inkjet head 12. In this case, the moving speed Vy of the inkjet head 12 is zero, and thus the ink droplet 302 lands at a position immediately below the nozzle 202 even if the speed Vi of the ink droplet 302 in the discharging direction is slowed by the influence of air resistance. Thus, in this case, the shift, and the like in the landing position are less likely to occur even if the gap distance becomes large.

As described above, immediately after being discharged from the nozzle 202, the speed Vi of the ink droplet 302 in the discharging direction is usually about five to fifteen times the moving speed Vy of the inkjet head 12. Thus, even if the inkjet head 12 is not completely stopped, for example, a case substantially similar to the case denoted with the reference numeral B is realized by setting the moving speed Vy to low speed, and the shift, and the like in the landing position are assumed to less likely to occur.

As apparent from FIG. 2A, and the like, the state of flying of the ink droplet 302 after being discharged differs according to the moving speed Vy of the inkjet head 12. More specifically, for example, the magnitude of the flight bend that occurs before landing becomes larger the greater the moving speed Vy of the inkjet head 12. As a result, the entering angle at the time of landing to the medium 50 becomes larger the greater the moving speed Vy of the inkjet head 12.

FIG. 2B is a view showing one example of an entering angle at a time of landing on the medium 50. As described above, the ink droplet 302 after being discharged advances toward the medium 50 while moving in the same direction as the inkjet head 12. However, the direction in which the ink droplet 302 flies gradually changes by the flight bend caused by the influence of air resistance. As a result, the ink droplet 302 lands on the medium 50 at the entering angle θ that changes according to the gap distance.

The entering angle of the ink droplet 302 is an angle formed by the flying direction of the ink droplet 302 at the time of landing, and the discharging direction in which the ink droplet 302 is discharged from the nozzle 202. More specifically, when discharging the ink droplet 302 from the nozzle 202 toward the lower side in the vertical direction, the entering angle of the ink droplet 302 is an angle formed by the flying direction of the ink droplet 302 at the time of landing and the vertically downward direction.

As apparent from FIG. 2A, and the like, the entering angle θ becomes large when the speed Vi of the ink droplet 302 in the discharging direction becomes slow. The shift and the variation in the landing position of the ink droplet 302 become larger the greater the entering angle θ. When the moving speed Vy of the inkjet head 12 is constant, the entering angle θ becomes larger the larger the gap distance. When the gap distance is constant, the entering angle θ becomes larger the greater the moving speed Vy.

Thus, when the gap distance is large, for example, the moving speed Vy of the inkjet head 12 is to be changed according to the gap distance to suppress the shift, variation, and the like in the landing position. This will be further described in detail below.

Figure 3:
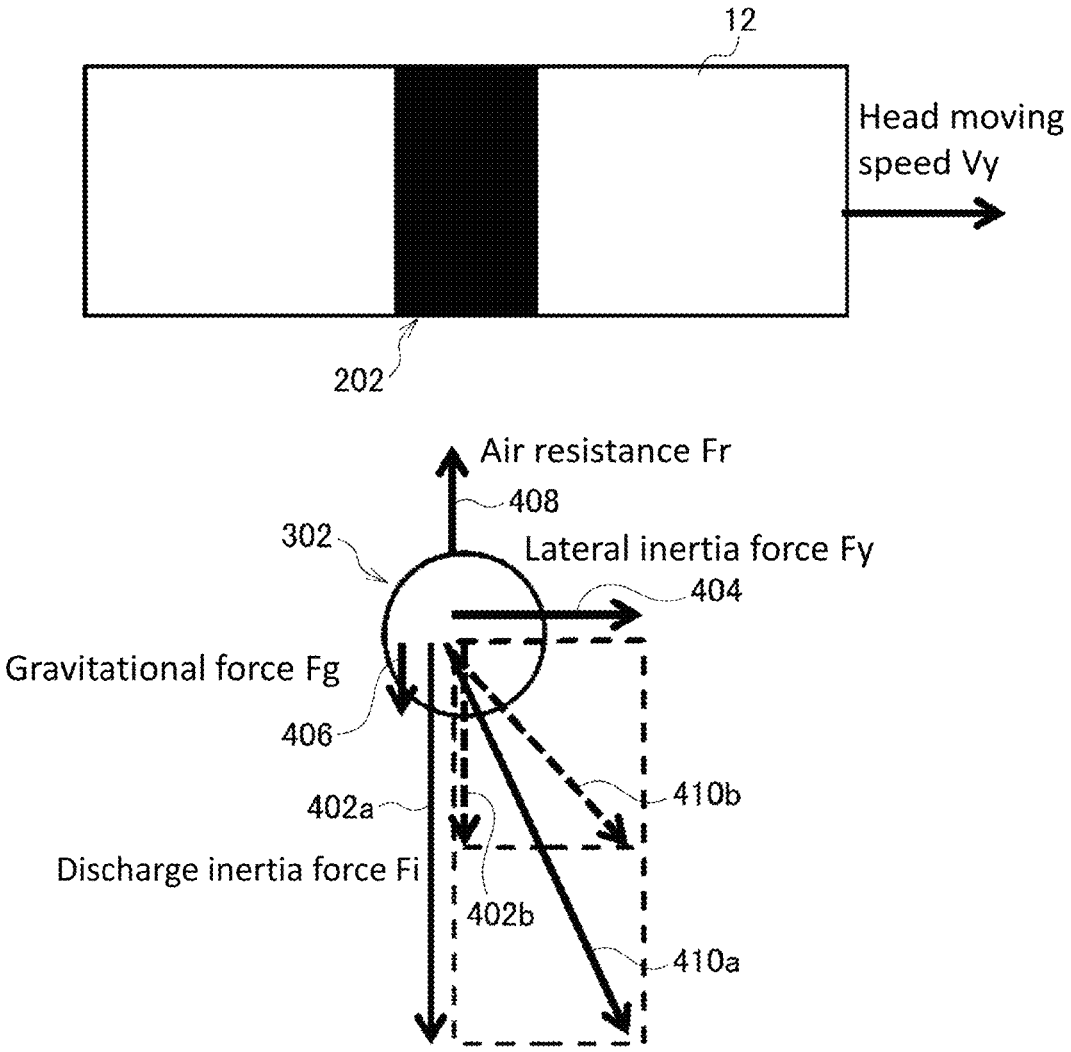
FIG. 3 is a view describing a force that acts on the ink droplet 302 in the air.

First, the state of the flying droplet 302 will now be further described in detail. FIG. 3 is a view describing a force that acts on the ink droplet 302 in the air. As shown in the figure, after being discharged from the nozzle 202, the flying ink droplet 302 receives a discharge inertia force Fi, a lateral inertia force Fy, a gravitational force Fg, and an air resistance Fr.

The discharge inertia force Fi is a force generated when the ink droplet 302 is discharged from the nozzle 202. The ink droplet 302 moves in the discharging direction at a kinetic energy $E=(1/2)m(Vi)^2$ according to the discharge inertia force Fi. In this case, Vi is the speed of the ink droplet 302 in the discharging direction. Furthermore, m is a mass of the ink droplet 302. More specifically, in the illustrated case, the ink droplet 302 immediately after being discharged flies at a speed indicated with an arrow 402*a* in the discharging direction by the discharge inertia force Fi.

The lateral inertia force Fy is a force corresponding to the moving speed Vy of the inkjet head 12 at the time of discharge. The ink droplet 302 immediately after being discharged flies at a speed indicated with an arrow 404 in the moving direction (hereinafter referred to as lateral direction) of the inkjet head 12.

The lateral inertia force Fy is a force that becomes a cause in the shift and the variation in the landing position. The lateral inertia force Fy, for example, can be expressed with a function f(Vy) of the moving speed Vy of the inkjet head 12. When the moving speed of the inkjet head 12 is Vy=0 (when the inkjet head 12 is stationary), Fy=0. In this case, the disturbance of the discharge in the lateral direction is alleviated. The shift, and the like in the landing position are also thereby alleviated.

The gravitational force Fg is a gravitational force received by the ink droplet 302. In the present example, the ink droplet 302 receives the gravitational force Fg=mg in the direction same as the direction the nozzle 202 discharges the ink droplet 302, as shown with an arrow 406. The air resistance Fr is an air resistance received by the flying ink droplet 302. Assuming the flying speed of the ink droplet 302 is v, the air resistance Fr can be assumed as, for example, Fr=kv (k is a constant). The ink droplet 302 receives the air resistance Fr in a direction opposite to the direction the nozzle 202 discharges the ink droplet 302, that is, a direction opposite to the gravitational force.

As a result of receiving the above forces, the direction and the speed of the flying speed of the ink droplet 302 become as shown with an arrow 410*a*, for example, immediately after being discharged from the nozzle 202. However, the air resistance Fr received by the flying ink droplet 302 is usually greater than the gravitational force Fg in the discharging direction. Thus, after the discharge, the speed of the ink droplet 302 in the discharging direction gradually lowers. As a result, the ink droplet 302 flies at a speed slower than immediately after being discharged due to the influence of air resistance at a time point when a time of a certain degree has elapsed from after the discharge. Such slow speed is, for example, a speed indicated with an arrow 402*b* shorter than an arrow 402*a*.

The moving speed Vy of the inkjet head 12 is usually small compared to the discharging speed of the ink droplet 302. Thus, in the lateral direction, the change in the speed of the ink droplet 302 by the air resistance can be substantially ignored compared to the change in the discharging direction. The speed component of the ink droplet 302 in the lateral direction thus can be assumed as substantially constant until the ink droplet lands on the medium 50.

In this case, the direction and the speed of the flying speed of the ink droplet 302 become as shown with an arrow 410*b*, for example, at a time point when the speed of the ink droplet 302 in the discharging direction becomes the state of the arrow 402*b*. In this case, as apparent from the comparison of the arrow 410*a* and the arrow 410*b*, a ratio of the speed in the discharging direction and the speed in the lateral direction changes, and hence the influence of the speed in the lateral direction can be said as being greater than immediately after the discharge. Furthermore, it can thus be recognized that when the speed of the ink droplet 302 in the discharging direction becomes slow due to the influence of air resistance, for example, the bend in the lateral direction becomes large. As a result, it is apparent that the entering angle at the time of landing becomes large.

In the present example, on the other hand, the entering angle at the time of landing is prevented from becoming too large by controlling the moving speed Vy of the inkjet head 12 in the main scanning operation. Control of the moving speed Vy of the inkjet head 12 in the main scanning operation will be further described in detail below.

Figure 4:
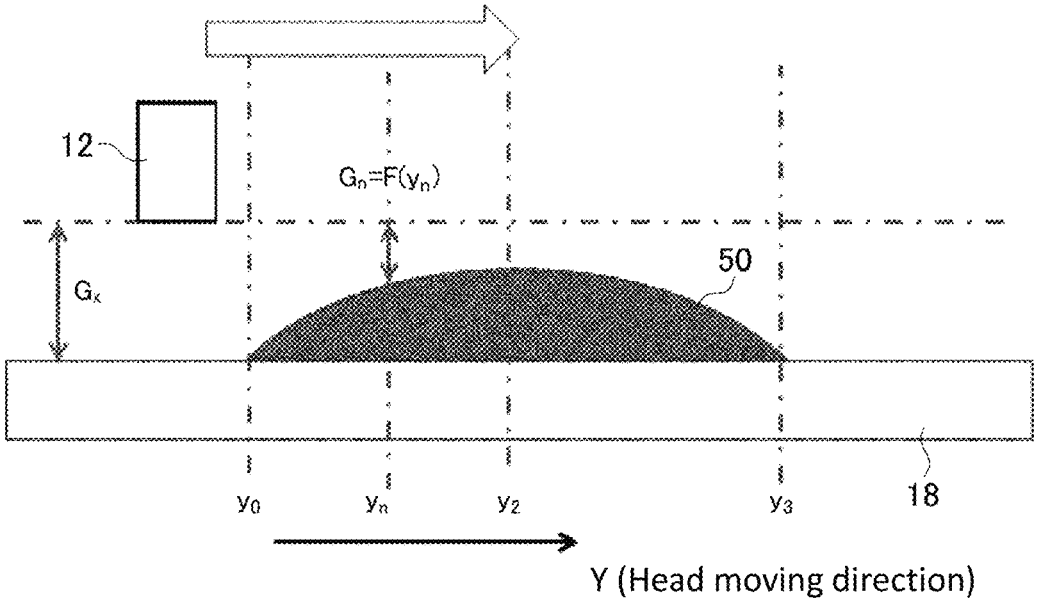
FIG. 4 is a view describing an operation of printing carried out in the present example.

FIG. 4 is a view describing an operation of printing carried out in the present example, and shows one example of operation and control of the operation of when carrying out printing on the three-dimensional medium 50. The three-dimensional medium 50 is, for example, a medium 50 in which a surface to be printed is not flat, as shown in the figure. The surface to be printed is, for example, a surface that faces the inkjet head 12. For the sake of convenience of illustration, the configuration of the printing apparatus 10 shown in FIG. 1A and FIG. 1B is shown in a simplified manner in FIG. 4.

When carrying out printing on such medium 50, the gap distance differs for each position of the surface to be printed of the medium 50. More specifically, for example, assuming a position (position in Y axis direction) at each timing of the moving inkjet head 12 is $y_n$ at the time of the main scanning direction, the gap distance $G_n$ at the relevant position is expressed with the function F corresponding to the shape of the medium 50 so as to become $G_n=F(y_n)$.

As already described above, if the moving speed Vy of the inkjet head 12 at the time of the main scanning operation is constant, for example, the flying direction and the like of the ink droplet 302 at the time of landing change when the gap distance is changed. Thus, when the gap distance becomes large, the entering angle of the ink droplet 302 at the time of landing becomes large, and the shift, variation and the like in the landing position tend to become large.

In the present example, on the other hand, the controller 22 (see FIG. 1A and FIG. 1B) sets the moving speed Vy of the inkjet head 12 at the time of the main scanning operation according to the gap distance. More specifically, for example, the moving speed Vy of the inkjet head 12 in the main scanning operation is set such that the entering angle at the time of landing of the ink droplet on the medium 50 becomes smaller than or equal to 45 degrees with respect to at least a position where the gap distance becomes the largest in the region of the medium 50 to become a target of each main scanning operation.

When configured in such manner, the entering angle of the ink droplet can be appropriately prevented from becoming too large even, for example, at the landing position where the gap distance becomes large. The component toward the medium 50 thus can be made greater than the component in the moving direction of the inkjet head 12 in the flying direction of the ink droplet immediately before landing. According to such configuration, the shift, and the like in the landing position thus can be assumed to be appropriately prevented from becoming large even, for example, when the gap distance is large. Printing thus can be more appropriately carried out with high precision. Furthermore, in such a case, the ink droplet can be landed while maintaining the component toward the medium 50 to a certain degree, and hence atomization and the like of the ink droplet can also be assumed to be appropriately prevented.

More specifically, when using a substantially dome shaped medium 50 as shown in FIG. 4, for example, the moving speed of the inkjet head 12 at the time of the main scanning operation can also be assumed to change along a substantially dome shape. The position where the gap distance becomes the largest may be a position where the gap distance becomes the largest of the landing positions determined according to the resolution of printing.

Figure 5A:
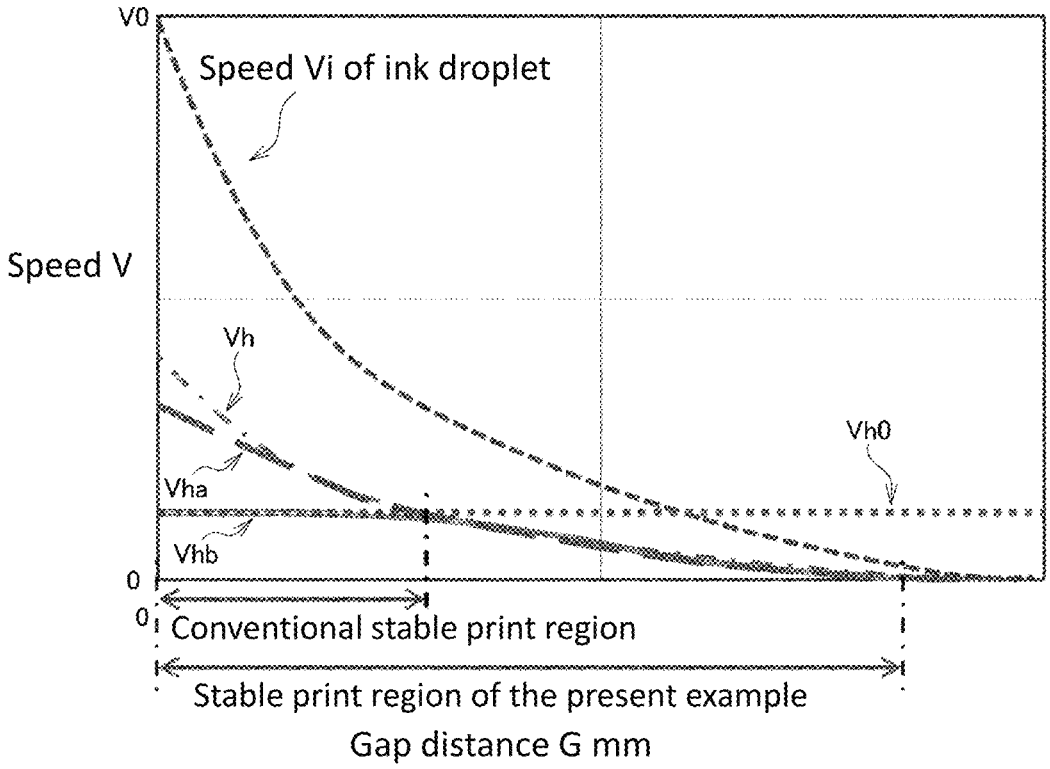
FIG. 5A and FIG. 5B are views describing one example of control of a moving speed Vy of the inkjet head 12.
Figure 5B:
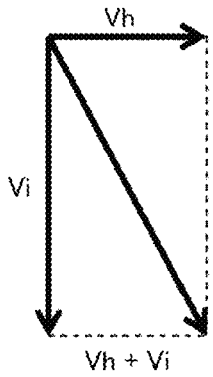

Next, control of the moving speed Vy of the inkjet head 12 will be described in more detail. FIG. 5A and FIG. 5B are views describing one example of control of a moving speed Vy of the inkjet head 12. FIG. 5A is a graph showing one example of setting of the moving speed Vy. FIG. 5B is a view describing a flying direction of the ink droplet.

As described above, the speed of the flying ink droplet gradually changes by the influence of air resistance, and the like. More specifically, for example, when an initial speed of the ink droplet in the discharging direction is V0, the speed Vi of the ink droplet in the discharging direction can be approximated as $Vi=V0\times\exp(-t/\tau)$ at a time point when a time t has elapsed after the discharge. In such a case, the initial speed V0 of the ink droplet is the discharging speed at which the inkjet head 12 discharges the ink droplet from the nozzle. The speed V0 may be a speed in the discharging direction of the ink droplet immediately after being discharged from the nozzle. Furthermore, $\tau$ is a time constant of speed attenuation determined according to a capacity, and the like of the ink droplet.

When discharging the ink droplet by the main scanning operation, the speed at which the ink droplet flies also includes a component in the lateral direction orthogonal to the discharging direction. Immediately after the discharge, the speed in the lateral direction of the ink droplet is the same as the moving speed of the inkjet head 12. As already described above, the speed of the ink droplet in the lateral direction can be assumed as substantially constant partly due to the influence of airflow that moves at the same speed as the movement of the head until the ink droplet lands on the medium 50.

Thus, assuming the moving speed of the inkjet head 12 at the time of discharge is Vh, the actual flying direction of the ink droplet becomes a direction of a vector in which the speed Vi and the speed Vh, which directions are orthogonal, are combined, as shown in FIG. 5B, at each timing. In this case, Vh is to be set so that Vi is satisfied at the timing of landing to make the entering angle at the time of landing smaller than or equal to 45 degrees. In such a case, more specifically, the controller 22 sets the moving speed Vh of the inkjet head 12 at each timing of discharging the ink droplet to each position in the region of the medium 50 to become a target of the main scanning operation so that Vi is satisfied at least until the ink droplet lands on the medium 50. According to such configuration, the moving speed Vh of the inkjet head 12 can be appropriately set to a speed corresponding to the gap distance.

In the graph shown in FIG. 5A, a dotted line indicated as Vh0 is a reference line indicating a case where the moving speed of the inkjet head 12 is set to a predetermined constant value Vh0. In this case, Vi≥Vh0 is realized in a region where the gap distance G is small, and hence the entering angle at the time of landing can be made to greater than or equal to 45 degrees. However, Vi<Vh0 is realized in a region where the gap distance is larger than an intersection of the curve of Vi and the dotted line of Vh0, and hence the entering angle at the time of landing becomes large. As a result, the shift, and the like in the landing position tend to easily occur. In contrast, setting Vh such that Vi≥Vh is realized, as described above, is comparable to setting Vh so as to always be on the lower side of the curve of Vi.

In order to suppress the shift and the variation in the landing position, at least the entering angle of the ink droplet at the time of landing is desirably set to smaller than or equal to 45 degrees, as described above. However, the discharging speed of the ink droplet is usually about five to fifteen times the moving speed of the inkjet head. Thus, when the gap distance is small, the entering angle of the ink droplet is usually smaller than 45 degrees, and is, for example, about smaller than or equal to 20 degrees. In view of such point, even when the gap distance becomes large, it is assumed to be more preferable to land the ink droplet at the entering angle of the same extent as when the gap distance is small without, for example, changing the direction of the resultant vector shown in FIG. 5B.

In this case, assuming N is a constant of about one to fifteen, the moving speed Vh is assumed to be set so that Vi/Vh≥N is satisfied for each position in the region of the medium 50 to become the target of the main scanning operation by the controller 22. In this case, the speed Vi may, for example, be a speed at the timing of landing. The constant N is, for example, a ratio ($N=V0/Vh_{max}$) of the discharging speed V0 and the maximum speed $Vh_{max}$ set in advance for the moving speed of the inkjet head 12. More specifically, in this case, a maximum value of the moving speed Vh of the inkjet head 12 that can be set according to the gap distance becomes $Vh=(1/N)\times Vi=(1/N)\times V0\times\exp(-t/\tau)$, where t is the time until the ink droplet lands in such gap distance. The Vh in this case is indicated as a curve Vh in FIG. 5A.

With respect to the moving speed Vh of the inkjet head 12, a range for Vi/Vh≥N can be said as a region where printing can be carried out more stably (stable print region). However, for example, when the moving speed of the inkjet head 12 is set constant (Vh0) as in the conventional configuration, printing can be stably carried out only in a short range until the curve Vh and the dotted line Vh0 intersect, as shown as a conventional stable print region in the graph.

On the other hand, when the moving speed is changed according to the gap distance as in the present example, printing can be stably carried out in a wider range, as shown as a stable print region of the present example in the graph. Thus, from such aspect as well, it is apparent that printing can be appropriately carried out even when the gap distance is wide according to the present example.

Furthermore, the moving speed of the inkjet head 12 can be appropriately set in a range not exceeding the curve Vh in the graph. For example, as shown with a curve Vha in the graph, a speed slower than as indicated with the curve Vh may be set. According to such setting, a speed corresponding to the gap distance can be appropriately set for the moving speed of the inkjet head 12.

Furthermore, for example, as shown with a curve Vhb, a constant upper limit value may be provided for the moving speed to limit the moving speed of when the gap distance is small. More specifically, in this case, the controller 22 sets the moving speed to the maximum speed $Vh_{max}$ set in advance with respect to a position where the gap distance is smaller than or equal to a set gap, which is a distance set in advance, and sets the moving speed to a speed lower than the maximum speed $Vh_{max}$ with respect to a position where the gap distance is greater than the set gap while the inkjet head 12 carries out one main scanning operation. According to such configuration, the moving speed of the inkjet head 12 can be appropriately prevented from becoming too high. Furthermore, for example, control can be appropriately prevented from becoming difficult, the cost of the apparatus can be appropriately prevented from greatly increasing, and the like.

The moving speed of the inkjet head 12 may be changed according to the gap distance at each position so as to gradually reduce according to the gap distance from a constant speed, for example, in each main scanning operation. In this case, the controller 22 changes the moving speed of the inkjet head 12 at a timing of discharging the ink droplet to each position according to the gap distance at each position in the region of the medium 50 to become the target of the main scanning operation while the inkjet head 12 carries out one main scanning operation. According to such configuration, the moving speed of the inkjet head 12 can be appropriately set in accordance with the gap distance at each position. Printing thus can be appropriately carried out at high precision even when the gap distance is large at any position.

The moving speed of the inkjet head 12 may be changed, for example, in a plurality of stags (e.g., about three to five stages) set in advance. In this case, the controller 22 changes the moving speed of the inkjet head 12 by selecting from the plurality of stages.

More briefly, consideration is made, for example, to setting the moving speed of the inkjet head 12 for every main scanning operation without changing the moving speed during the one main scanning operation. In this case, the controller 22 sets the moving speed of the inkjet head 12 for every main scanning operation. The controller 22 may, for example, set the moving speed of the inkjet head 12 for every plurality of main scanning operations set in advance. The controller 22 thus moves the inkjet head 12 at a constant moving speed in each main scanning operation.

When the gap distance in a region to become the target of the main scanning operation is small, the controller 22 may set the moving speed of the inkjet head 12 to a maximum speed set in advance. More specifically, when the maximum value of the gap distance in the region of the medium 50 to become the target of the main scanning operation is smaller than or equal to the set gap, which is the distance set in advance, the controller 22 sets the moving speed of the inkjet head 12 in the relevant main scanning operation to the maximum speed set in advance. When the gap distance becomes greater than the set gap at any position in the region of the medium 50 to become the target of the main scanning operation, the controller 22 sets the moving speed in the relevant main scanning operation according to the maximum value of the gap distance in the region. When configured in such manner, a minimum moving speed corresponding to the maximum value of the gap distance is used for all the gap distances. According to such configuration, a speed corresponding to the gap distance can be more simply and appropriately set for the moving speed of the inkjet head 12.

Next, the operation of printing carried out using the printing apparatus 10 of the present example will be more specifically described. As already described above, when carrying out printing through the inkjet method, the state at the time of landing of the ink droplet differs according to the gap distance. For example, when the gap distance is small, the lowering in speed of the ink droplet until the time of landing is small, and the landing position becomes accurate. In this case, for example, printing is carried out at high speed by setting the moving speed of the inkjet head 12 to a maximum speed in the present example.

For example, when the gap distance is a middle degree, the speed of the ink droplet lowers by the time of landing. Thus, in this case, the landing position of the ink droplet becomes slightly inaccurate if the moving speed of the inkjet head 12 is fast. On the contrary, in the present example, printing is carried out at middle speed with the moving speed of the inkjet head 12 set slower than the maximum speed.

When the gap distance is large, the speed of the ink droplet greatly lowers by the time of landing. Thus, in this case, the landing position of the ink droplet greatly shifts if the moving speed of the inkjet head 12 is fast. In the present example, on the other hand, printing is carried out while having the moving speed of the inkjet head 12 as slow as possible. As described in association with FIG. 1A and FIG. 1B, the stepping motor 106 is used for a power source of the main scan driver 14 in the present example. In this case, the inkjet head 12 can be stopped once at the time of discharge of the ink droplet. Thus, when the gap distance is large, the speed of the inkjet head 12 may be set to zero at the time of discharge of the ink droplet.

More specifically, for example, when the gap distance is greater than an upper limit distance set in advance at any of the positions in the medium 50, the controller 22 may bring the inkjet head 12 to rest at least at a timing of discharging the ink droplet to a position where the gap distance becomes greater than the upper limit distance. The upper limit distance may, for example, be a distance of about 10 mm. According to such configuration, the shift, and the like in the landing position can be appropriately suppressed even when the gap distance is particularly large. Furthermore, printing thus can be more appropriately carried out at high precision.

Furthermore, consideration is made to automatically controlling the moving speed of the inkjet head 12 in the following manner according to the gap distance. For example, consideration is made to determining the moving speed of the inkjet head 12 in accordance with the maximum gap distance in the medium 50 for every medium 50 to become the target of printing. In this case, the same moving speed is used with respect to the entire medium 50. For example, when the gap distance at any position is large, printing is carried out at low speed with respect to the entire medium 50.

When information on the gap distance is obtained for each position of the medium 50, consideration is made to adjustment controlling the moving speed of the inkjet head 12 in accordance with the change in the gap distance by position. In this case, in view of step-out prevention, vibration prevention, and the like of the motor, it is preferable to regulate a maximum changing rate by for example, making the change in adjustment speed gradual so that the moving speed of the inkjet head 12 does not change rapidly.

Furthermore, for example, consideration is made to changing the moving speed of the inkjet head 12 corresponding to the gap distance based on data of a relationship, and the like of the gap distance determined in advance and a recommended print speed that does not affect the image quality. In this case, setting of the moving speed of the inkjet head 12 may be carried out manually by the operation of a user, or may be carried out automatically.

When the gap distance is large to a margin extent at which printing can be carried out such as when the gap distance exceeds 10 mm, and the like, for example, the ink droplet may be discharged while stopping the stepping motor 106 serving as a drive source for moving the inkjet head 12. Printing can be appropriately carried out on the medium 50 having various gap distances by carrying out printing in the above manner.

When the moving speed of the inkjet head 12 is slowed according to the gap distance as in the present example, the lowering in the printing speed may arise as a problem. In this case, for example, consideration can be made in reducing the influence of the lowering in the moving speed of the inkjet head 12, and the like by increasing the number of inkjet heads 12 for each color. More specifically, for example, consideration is made in using a plurality of inkjet heads 12 lined in the main scanning direction, and the like for one color.

According to the present example, printing through the inkjet method can be appropriately carried out even when the gap distance is large, as described above. However, when carrying out printing through the inkjet method, for example, the gap distance may have a practical limit caused by, for example, a configuration of discharging the ink droplet from the moving inkjet head 12, and the like. This will be described in more detail.

Figure 6:
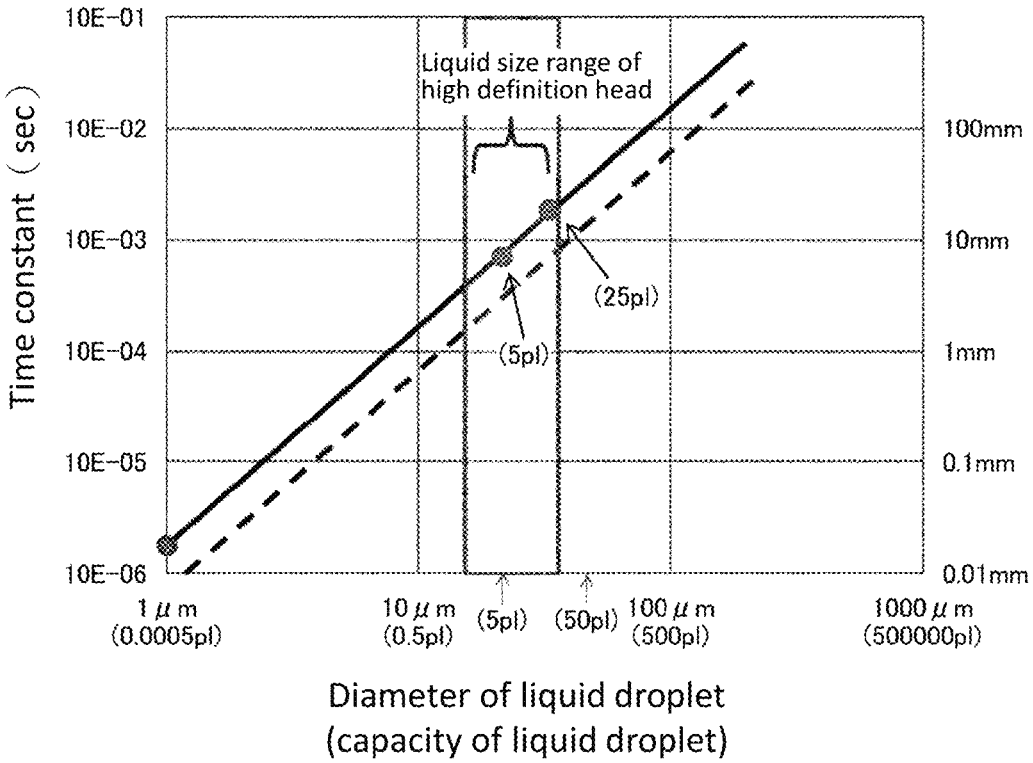
FIG. 6 is a graph describing a practical limit of a gap distance.

FIG. 6 is a graph describing the practical limit of the gap distance, and shows one example of a relationship of a time constant related to the speed attenuation of the ink droplet in the air, a size of the ink droplet, and a limit gap. In this case, the time constant related to the speed attenuation of the ink droplet in the air is, for example, a time constant τ described in association with FIG. 5A and FIG. 5B. The size of the ink droplet is a diameter of a liquid droplet and a capacity of a liquid droplet shown in the graph of FIG. 6. In this case, the liquid droplet is the ink droplet. The limit gap is a maximum gap distance at which printing can be carried out in a calm surrounding.

In the graph, a solid line is a maximum reaching distance of when the ink droplet is discharged (time of stationary print) while the inkjet head 12 is stationary. In this case, the limit gap becomes equal to a maximum reaching distance Lmax of the ink droplet. The maximum reaching distance Lmax of the ink droplet refers to, for example, a distance where the speed of the ink droplet in the discharging direction becomes zero.

In the graph, a broken line indicates a limit gap of when the inkjet head 12 is moved at a speed of 1 m/sec. In this case, the landing position becomes inaccurate when the speed of the ink droplet in the discharging direction becomes zero since the speed of the ink droplet has a component in the lateral direction. Thus, the limit gap becomes smaller than the maximum reaching distance Lmax.

However, when the moving speed of the inkjet head 12 is further slowed, the limit gap approaches the maximum reaching distance Lmax. Thus, when changing the moving speed of the inkjet head 12 according to the gap distance as in the present example, the limit gap theoretically becomes a value close to the maximum reaching distance Lmax.

When carrying out printing through the inkjet method, the size of the ink droplet needs to be made small to carry out high definition printing at high resolution. More specifically, for example, the ink droplet of a size shown in the figure is used for a liquid droplet size range of the high definition head. When based on the graph of FIG. 6, a high definition printing can be appropriately carried out when the ink droplet capacity is greater than about 6 p1 if, for example, the gap distance is theoretically smaller than or equal to about 10 mm in a calm state.

Figure 7:
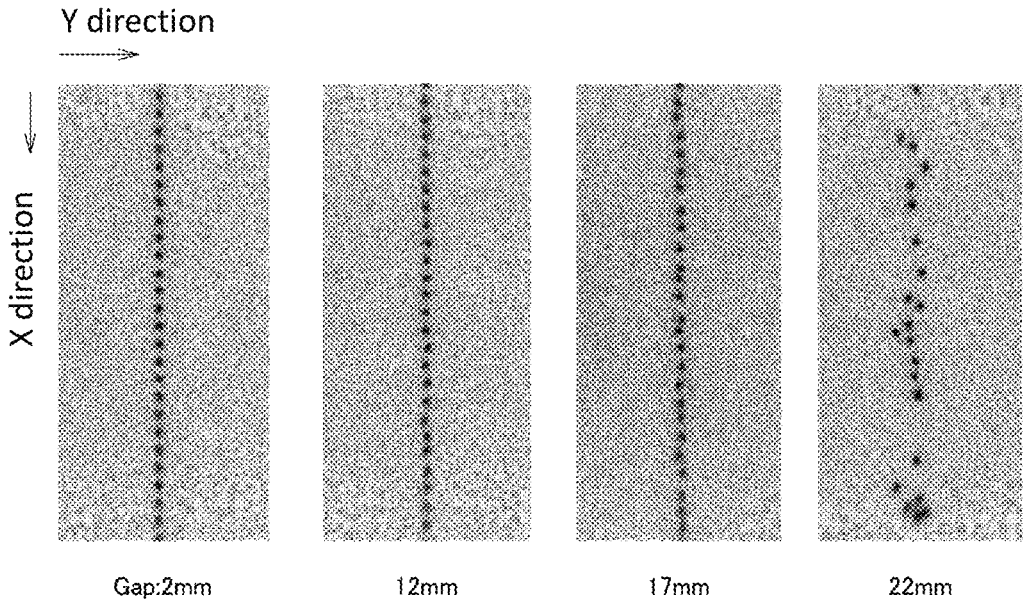
FIG. 7 shows a result of an experiment where printing was carried out with the inkjet head 12 in a stationary state.

FIG. 7 shows a result of an experiment in which printing was carried out with the inkjet head 12 in a stationary state. In this experiment, the inkjet head 12 was moved by the power of the stepping motor 106 as described in association with FIG. 1A and FIG. 1B, and the like. The inkjet head 12 was brought to rest at a timing the inkjet head 12 reached each position of discharging the ink droplet. The ink droplet was discharged from the stationary inkjet head 12. The Y direction shown in the figure is a head moving direction.

When the ink droplet is discharged while moving the inkjet head 12 at a moving speed corresponding to a small gap distance as in the conventional configuration, for example, the disturbance in the landing position of the ink droplet becomes large and printing becomes difficult to carry out appropriately if the gap distance becomes greater than or equal to about 5 mm. On the other hand, when the inkjet head 12 is brought to rest as described above, the shift, variation, and the like in the landing position can be suppressed and printing can be appropriately carried out even when the gap distance is about 17 mm, for example.

Although the illustration is omitted, the limit gap can be appropriately increased compared to the conventional configuration, for example, by slowing the moving speed of the inkjet head 12 according to the gap distance even if, for example, the inkjet head 12 is not completely brought to rest. Thus, as apparent from such experiment as well, printing can be appropriately carried out at high precision even when the gap distance is large according to the configuration of the present example.

Figure 8:
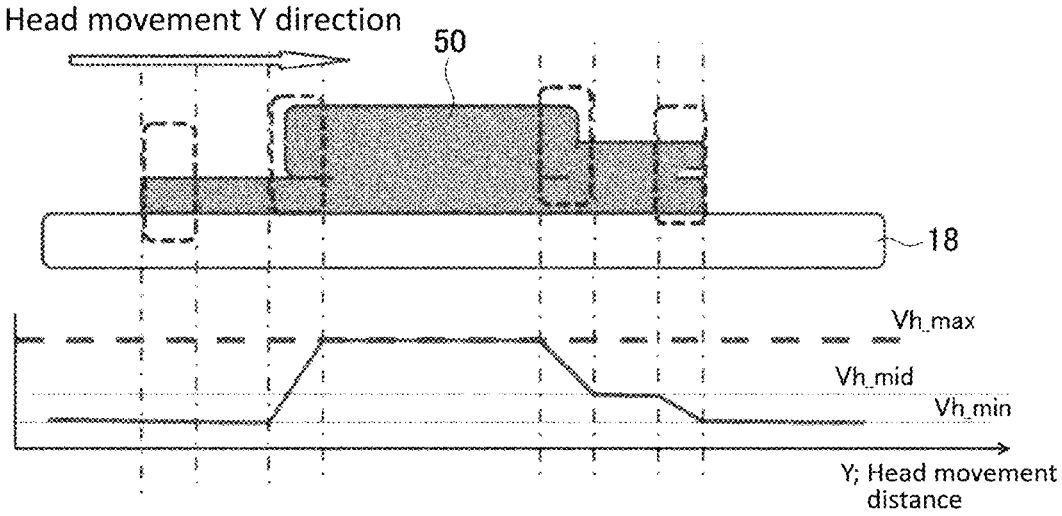
FIG. 8 is a view showing one example of an operation of printing carried out with respect to a three-dimensional medium 50.

Next, an operation of carrying out printing with respect to the three-dimensional medium 50 by means of the printing apparatus 10 of the present example will be described in further detail. FIG. 8 shows one example of an operation of printing carried out with respect to the three-dimensional medium 50.

In the present example, printing can be appropriately carried out even with respect to the medium 50 having unevenness since the high precision printing can be carried out even when the gap distance is a large wide gap. The printing apparatus 10 changes the moving speed of the inkjet head 12 according to the gap distance at each position. More specifically, for example, in the case shown in FIG. 8, the moving speed of the inkjet head 12 is set to a maximum speed Vh_max with respect to a position where the gap distance is small. The moving speed of the inkjet head 12 is set to a medium speed Vh_mid with respect to a position where the gap distance is a medium degree. The moving speed of the inkjet head 12 is set to a minimum speed Vh_min with respect to a position where the gap distance is large. According to such configuration, the moving speed of the inkjet head 12 can be appropriately set according to the gap distance.

In this case, the moving speed of the inkjet head 12 can be slowed gradually or in a step wise manner with respect to a position where disturbance of the landing position easily occurs such as, for example, a position to become an end of a figure, and the like, in addition to a position where the gap distance is large. In this case, the position to become the end of the figure is, for example, a position surrounded with a broken line in FIG. 8. According to such configuration, for example, printing can be more appropriately carried out with respect to the three-dimensional medium 50.

A configuration of varying the moving speed of the inkjet head 12 can be suitably used for other than the time of printing on the three-dimensional medium 50. More specifically, for example, consideration is also made to slowing the moving speed of the inkjet head 12, and the like when printing a thin line extending in the X axis direction, and the like, as will be described below.

Figure 9:
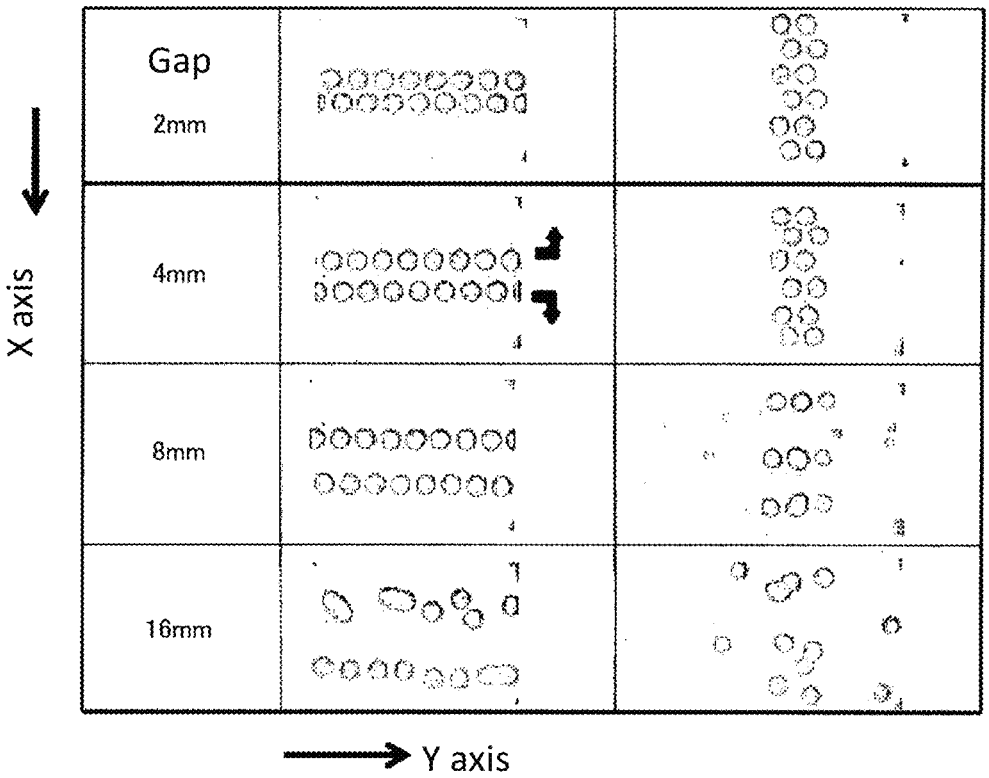
FIG. 9 is a view showing a result of an experiment related to a relationship of a direction of a line to draw and a shifting manner of a landing position.

FIG. 9 shows a result of an experiment related to a relationship of a direction of a line to draw, and a shifting manner of the landing position. In this experiment, the thin lines in the X axis direction and the Y axis direction were printed with the moving speed of the inkjet head 12 constant. The gap distance was differed in a range of 2 to 16 mm.

When carrying out printing through the inkjet method, the speed of the ink droplet sometimes lowers near the end of the inkjet head 12 due to the influence of a self-airflow generated accompanying the movement of the inkjet head 12. As a result, the thin line extending in the Y axis direction and the position of a dot of the ink formed by the nozzle at the end of the inkjet head 12 may shift toward the outer side as shown with an arrow in the figure. As a result, as apparent from the figure, the influence of the disturbance of the landing position becomes large when, for example, drawing a line extending in the X axis direction while the gap distance is large.

Thus, consideration is made to slowing the moving speed of the inkjet head 12 such as when printing a thin line extending in the X axis direction, and the like, as described above. According to such configuration, the thin line extending in the X axis direction, and the like can be appropriately drawn even when the gap distance is large.

Figure 10A:
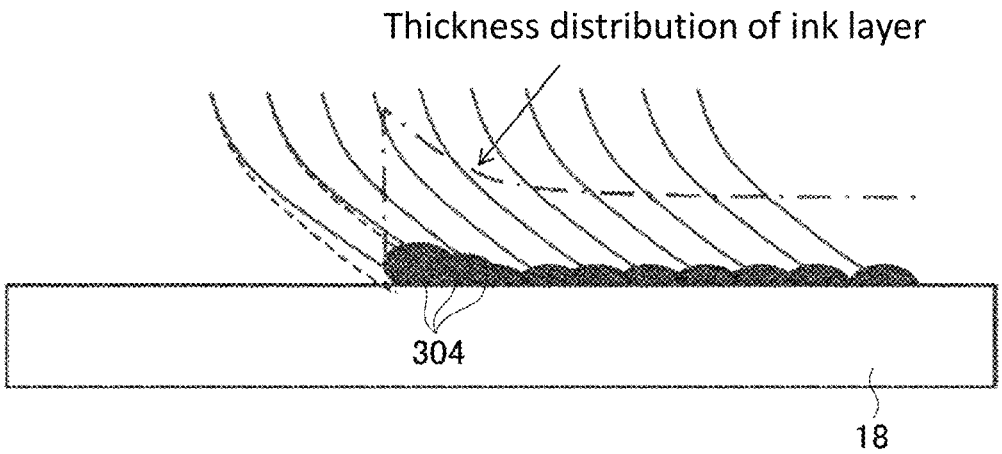
FIG. 10A, FIG. 10B and FIG. 10C are views describing an operation of when using a printing apparatus 10 as a three-dimensional object molding apparatus.
Figure 10B:
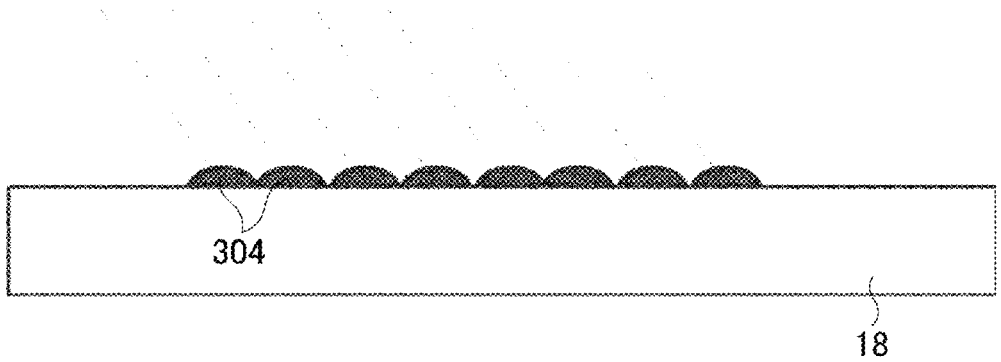
Figure 10C:
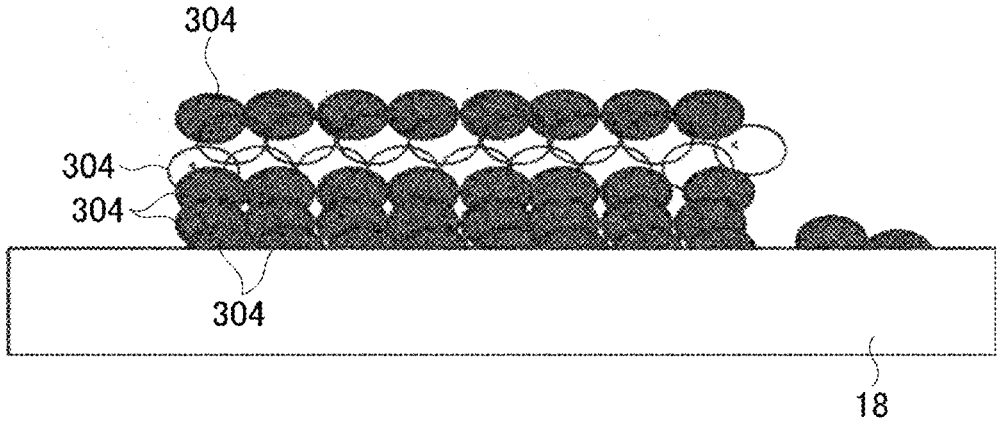

In recent years, consideration is made to carrying out molding of a three-dimensional object, and the like using the configuration of the inkjet printer using the ultraviolet curing ink. According to such configuration, for example, a configuration of an inkjet printer being widespread used can be utilized as a three-dimensional molding apparatus such as a 3D printer. A configuration of varying the moving speed of the inkjet head 12 in the present example can also be applied, for example, when using the printing apparatus 10 as the three-dimensional object molding apparatus. FIG. 10A, FIG. 10B and FIG. 10C are views describing an operation of when using the printing apparatus 10 as a three-dimensional molding apparatus, and shows an example of a problem that may arise when the moving speed of the inkjet head 12 is constant.

FIG. 10A shows a first problem that arises in the three-dimensional object molding apparatus. When using the printing apparatus 10 as a three-dimensional molding apparatus (3D printer, etc.), a plurality of ink layers are stacked and formed on the table 18 to mold a three-dimensional object. When carrying out printing through the inkjet method, however, the speed of the ink droplet at a head portion is usually slowed slightly by the influence of the surrounding atmosphere, and the like. Due to such influence, the interval of the dots 304 of the ink are in a closely spaced state at the head portion, and the position of the upper surface of the ink layer becomes slightly higher than the other portions. Such change is to an extent that does not stand out when carrying out the usual printing (printing through 2D). However, in the case of the three-dimensional molding apparatus of stacking a plurality of ink layers, errors are repeatedly accumulated across the multiple layers, and thus may stand out as a difference in height, as shown with a dotted dashed line in the figure.

When the printing apparatus 10 of the present example is used, on the other hand, the moving speed of the inkjet head 12 can be slowed to reduce the error for the portion where such error is likely to occur. The occurrence of difference in height by the error thus can be appropriately prevented in the three-dimensional object to mold.

FIGS. 10B and 10C show a second problem that arises in the three-dimensional object molding apparatus. FIG. 10B shows one example of a first ink layer formed on the table 18. FIG. 10C shows one example of a state in which a plurality of ink layers are stacked.

As described above, when using the printing apparatus 10 as the three-dimensional object molding apparatus, the three-dimensional object is molded by stacking and forming a plurality of ink layers. The respective ink layers are formed by having the inkjet head 12 carry out the main scanning operation. In this case, for example, the ink droplet enters from a diagonal direction, as shown in FIG. 10B. The entering angle is determined according to the discharging speed of the ink droplet from the nozzle of the inkjet head 12, the moving speed of the inkjet head 12 at the time of discharge, and the like.

In this case, as shown in FIG. 10C, in the ink layer after the second layer, a force in a direction of returning toward an inner side direction of the layer acts on the dot 304 of the ink by entering in the diagonal direction at one end (left side in the figure). Thus, a plurality of layers tend to be easily and appropriately stacked at one end.

However, at an end on the opposite side (right side in the figure), a force in a direction of causing the dot 304 to run out toward an outer side direction of the layer acts by entering in the diagonal direction. Thus, the dot 304 of the upper layer easily drops off near such end. As a result, the surface of the three-dimensional object to be molded may become rough.

When the printing apparatus 10 of the present example is used, on the other hand, the moving speed of the inkjet head 12 can be slowed near the end, and the like where drop-off of the dot 304 tends to easily occur. The surface of the three-dimensional object to be molded thus can be prevented from becoming rough. Thus, when the configuration of the printing apparatus 10 of the present example is used, molding of the three-dimensional object also can be carried out more appropriately.

The present invention has been described above using embodiments, but the technical scope of the invention is not limited to a scope described in the above-described embodiments. It is apparent to those skilled in the art that various changes or modifications can be made on the above-described embodiments. It is apparent from the description of the Claims that modes in which such changes or modifications are made are also encompassed within the technical scope of the invention.

INDUSTRIAL APPLICABILITY

The present invention can be suitably used, for example, for the printing apparatus.

The invention claimed is:

1. A printing apparatus that carries out printing through an inkjet method with respect to a medium, the printing apparatus comprising:

an inkjet head with a nozzle that discharges an ink droplet on the medium;

a main scan driver that causes the inkjet head to carry out a main scanning operation of discharging the ink droplet while moving in a main scanning direction set in advance; and a controller that controls a moving speed of moving the inkjet head in the main scanning operation; wherein the controller sets the moving speed according to a gap distance, which is a distance between a nozzle surface and the medium, and the nozzle surface is a surface where the nozzle is formed in the inkjet head; and the controller sets the moving speed in the main scanning operation so that an entering angle at a time of landing of the ink droplet on the medium becomes smaller than or equal to 45 degrees with respect to at least a position where the gap distance becomes the largest in a region of the medium to become a target of the main scanning operation, wherein when Vi, which is a component in a discharging direction of the ink droplet, in a flying speed of the ink droplet is approximated as $Vi=V0\times\exp(-t/\tau)$ using a time constant $\tau$, V0 being a discharging speed at which the inkjet head discharges the ink droplet from the nozzle, and t being a time elapsed after the ink droplet is discharged from the nozzle, the controller sets a moving speed Vh of the inkjet head at each timing of discharging the ink droplet to each position in the region of the medium to become a target of the main scanning operation so that $Vh\leq Vi$ is satisfied until at least each ink droplet discharged to each position lands on the medium.

* * * * *